United States Patent [19]

Nishikoori

[11] 4,202,571

[45] May 13, 1980

[54] LOCKING MEANS FOR AUTOMOBILE REAR DOORS

[75] Inventor: Tsutomu Nishikoori, Hiroshima, Japan

[73] Assignee: Toyo Kogyo Co., Ltd., Hiroshima, Japan

[21] Appl. No.: 924,557

[22] Filed: Jul. 14, 1978

[30] Foreign Application Priority Data

Jul. 18, 1977 [JP] Japan ..... 52-96044[U]

[51] Int. Cl.[2] ..... E05C 3/24

[52] U.S. Cl. ..... 292/216; 292/DIG. 23; 292/DIG. 42; 292/DIG. 43

[58] Field of Search ..... 292/216, 229, 198, 221, 292/227, DIG. 14, DIG. 23, DIG. 37, DIG. 41–43, DIG. 65; 296/76

[56] References Cited

U.S. PATENT DOCUMENTS 2,937,045 5/1960 Leslie et al. ..... 292/DIG. 37 X
3,614,146 10/1971 Marx ..... 292/216
4,073,170 2/1978 Miyabayashi et al. ..... 292/216 X

FOREIGN PATENT DOCUMENTS 630768 10/1949 United Kingdom ..... 292/216

*Primary Examiner*—William E. Lyddane
*Attorney, Agent, or Firm*—Fleit & Jacobson

[57] ABSTRACT

In an automobile having a rear opening adapted to be closed by a rear door, a locking device for the door which comprises a striker on the car body, a latch lever provided on the door for engagement with the striker, a claw lever provided on the door for releasably holding the latch lever in a locking position, an unlocking lever adapted for engagement with the claw lever, and a push button type actuating member for actuating the unlocking lever so that the latter drives the claw lever so as to let it release the latch lever for unlocking movement. The unlocking lever and the actuating member are both mounted on the outer panel of the door so that unlocking movement is not produced when the outer panel is deformed in a crash from behind.

4 Claims, 5 Drawing Figures

LOCKING MEANS FOR AUTOMOBILE REAR DOORS

The present invention relates to locking means for automobile doors and more particularly to locking means for rear doors.

Conventionally, automobiles having rear doors are provided with locking means for locking the doors on the automobile bodies. Such locking means generally comprises a latch lever mounted on the door for movement between locking and unlocking positions, and adapted to engage with a striker or locking pin on the body. The latch lever is normally biased toward the unlocking position and maintained at the locking position by a claw lever which is also mounted on the door. The door also carries an unlocking lever and a push button type unlocking member which are so arranged that when the push button is depressed the unlocking lever is swingably moved and the swinging movement of the unlocking lever is transmitted to the claw member to thereby release the latch lever.

Usually, the rear door is comprised of an outer and inner panels which are welded together along the peripheries thereof. In conventional arrangements, the unlocking lever is mounted on the inner panel and has an actuating leg positioned in the space between the inner and outer panels. The push button is mounted on the outer panel and adapted to engage, when depressed, with the actuating leg of the unlocking lever to cause the aforementioned swinging movement.

In this type of arrangements, problems have been experienced in that, when the automobile is crashed from behind and a deformation is produced in the outer panel, the unlocking lever is kicked by the push button causing the claw lever to move toward the releasing position with the result that the latch lever is moved under the bias force toward the unlocking position. Thus, the rear door is opened upon a crash and there may be a problem from the viewpoint of safety.

It is therefore an object of the present invention to provide locking means for automobile rear doors which does not have any problem of being unlocked upon a crash.

Another object of the present invention is to provide automobile rear door locking means which is simple in construction and in which the unlocking lever is moved together with the push button when the latter is moved forward due to deformations of the outer door panel which may be produced in a crash, so as to avoid any possibility of the locking means being unlocked upon a crash.

According to the present invention, the above and other objects can be accomplished in an automobile including a car body formed with a rear opening, and a rear door provided for closing said opening in the car body and being comprised of outer and inner panels which are secured together with a space therebetween, by locking means for the rear door which comprises striker means provided on the car body, latch lever means mounted on the door and movable between a locking position wherein it engages with the striker means and an unlocking position wherein it is disengaged from the striker means, bias means for biasing the latch lever means toward the unlocking position, claw lever means mounted on the door and adapted to engage with the latch lever means for releasably holding the latch lever means in the locking position, unlocking lever means pivotably mounted on said door and adapted to engage with said claw lever means, push button type actuating means mounted on said outer panel of the door for actuating, when depressed, the unlocking lever means so as to let it drive the claw lever means in a direction of releasing the latch lever means whereby the latch lever means is moved under the action of the bias means to the unlocking position, the improvement comprises the fact that said unlocking lever means is carried in the space of the door by said outer panel at an area close to said actuating means so that when the outer panel is deformed in a crash the actuating means is not moved with respect to the unlocking lever means by an amount sufficient to cause actuation of said unlocking lever means. The unlocking lever means is preferably mounted on a bracket which is in turn mounted in said space of the door on the outer panel and the claw lever means and the latch lever means are mounted on the inner panel through another bracket.

The above and other objects and features of the present invention will become apparent from the following descriptions of preferred embodiments taking reference to the accompanying drawings, in which.

Figure 1:
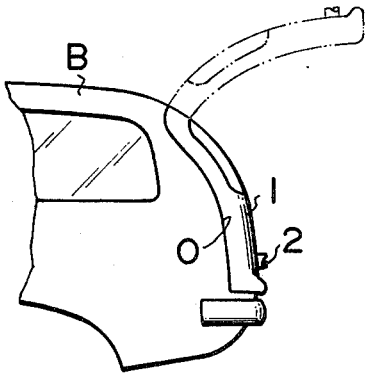
FIG. 1 is a fragmentary side view of an automobile specifically showing the rear portion thereof.

Referring to the drawings, particularly to FIG. 1, there is shown an automobile having a car body B formed with a rear opening O which is closed by a rear door 1. In order to lock the door 1 in closed position, there is provided a locking device which includes a push button type unlocking or actuating member 2.

Figure 2:
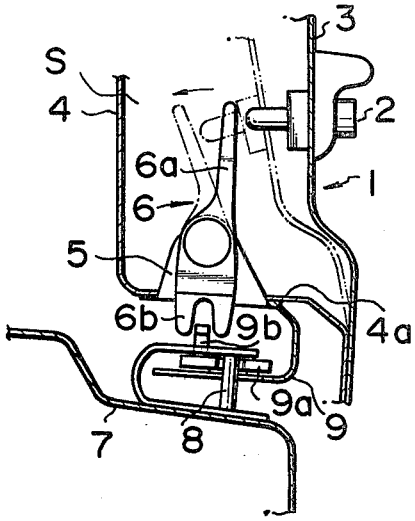
FIG. 2 (PRIOR ART)
FIG. 2 is a fragmentary sectional view showing a typical example of a rear door locking device in accordance with a conventional design.

Referring now to the prior art construction of FIG. 2, the rear door 1 is constituted by an outer panel 3 and an inner panel 4 which are welded together along the peripheries thereof with a space S defined therein. The aforementioned push button type actuating member 2 is mounted on the outer panel 3. At the bottom portion, the inner panel 4 has a flat deck 4*a* on which a bracket 5 is mounted. The bracket 5 pivotably carries an unlocking lever 6 which has an upwardly extending actuating leg 6*a* and a downwardly extending bifurcated portion 6*b*.

On the flat deck 4*a* of the inner panel 4, there is also mounted a base bracket 9 which carries a latch lever 9*a* and a claw lever 9*b*. The latch lever 9*a* is adapted to engage in a locking position with a striker 8 provided on a flat deck 7 of the car body B and the claw lever 9*b* is positioned so that it engages with the bifurcated portion 6*b* of the unlocking lever 6. Although not shown in FIG. 2, the latch lever 9*a* is biased by a spring toward an unlocking position but maintained in the locking position by the claw lever 9*b*. The actuating leg 6*a* of the unlocking lever 6 is located adjacent to the push button or actuating member 2 so that when the member 2 is depressed from outside the lever 6 is rotated counterclockwise as seen in FIG. 2 driving the claw lever 9*b*. Thus, the latch lever 9*a* is released and moved to the unlocking position under the bias force.

In this type of locking device, however, when the automobile is crashed from behind and the outer panel 3 is deformed as shown by phantom lines in FIG. 2, the actuating member 2 is toward the actuating leg 6*a* of the unlocking lever 6 and causes the lever 6 to move counterclockwise. Thus, the rear door 1 may be unlocked and opened upon a crash.

Figure 3:
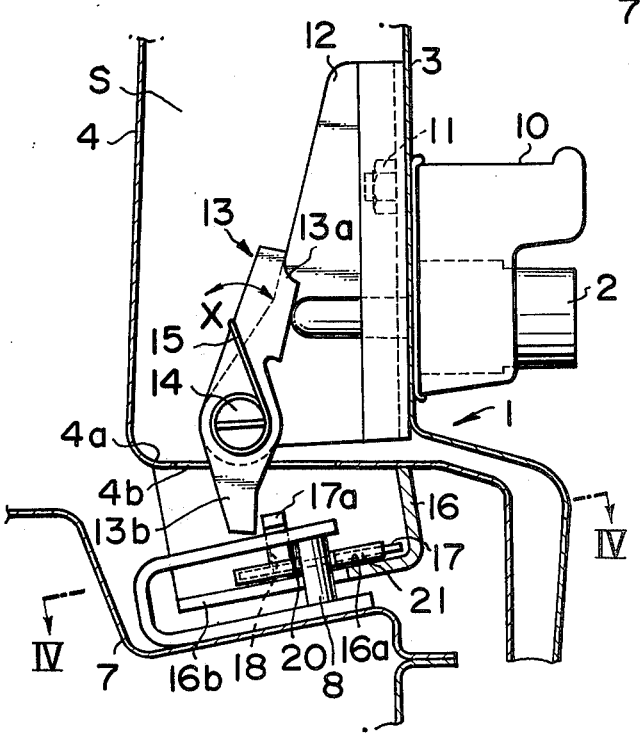
FIG. 3 is a sectional view similar to FIG. 2 but showing one embodiment of the present invention.

FIG. 3 shows an embodiment of the present invention in which the rear door 1 is comprised of an outer panel 3 and an inner panel 4 as in the aforementioned conventional structure. A push button type actuating member 2 is mounted on the outer panel 3 through a handle bracket 10 which is attached to the panel 3 by means of bolts and nuts 11.

In the space S between the panels 3 and 4 of the rear door 1, there is disposed a bracket 12 which is mounted on the panel 3 at a side opposite to the handle bracket 10. The bracket 12 carries an unlocking lever 13 through a pivot pin 14 and a spring 15 is provided for biasing the lever clockwise in FIG. 3. The unlocking lever 13 has an upper actuating portion 13*a* positioned adjacent to the member 2 to be attached thereby when the member 2 is depressed. The lever 13 further has a lower or operating portion 13*b* extending downwardly through an opening 4*b* formed in the flat deck 4*a* of the inner panel 4. The push button type member 2 is provided with a cylinder type lock so that it can be depressed only when the lock is released.

Figure 4:
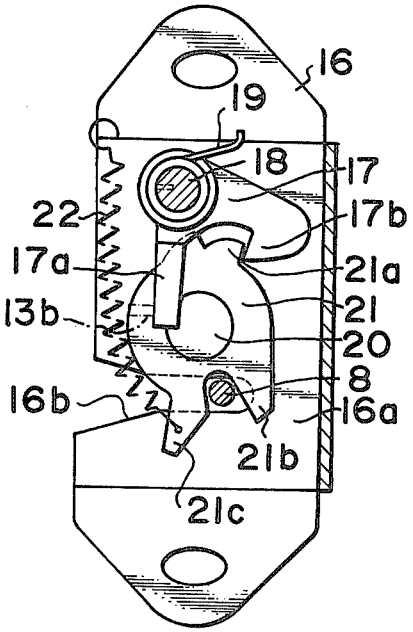
FIG. 4 is a view taken along the line IV—IV in FIG. 3.

Beneath the flat deck 4*a* of the inner panel 4, there is provided a latch bracket 16 which is mounted on the inner panel 4. As shown in FIG. 4, the latch bracket 16 has a bottom deck 16*a* and carries a latch lever 21 which is swingably mounted on the deck 16*a* of the bracket 16 by means of a vertical pin 20. The latch lever 21 has a claw 21*a* and latching fingers 21*b* and 21*c* and is biased clockwise as seen in FIG. 4 by means of a spring 22. As in the conventional structure, a striker 8 is provided on the rear deck 7 of the car body and the latch bracket 16 is formed at the deck 16*a* with a slot 16*b* for receiving the striker 8. As the door 1 is closed, the latch bracket 16 is moved with respect to the striker 8 so that the striker 8 is proceeded into the slot 16*b* and engages the latching finger 21*b* to rotate the latch lever counterclockwise against the force of the spring 22 into the locking position as shown in FIG. 4.

The latch bracket 16 further carries a claw lever 17 which is mounted thereon for swinging movement through a vertical pin 18. The claw lever 17 has an upward projection or engagement portion 17*a* and a claw 17*b* and is biased clockwise by means of a spring 19 as seen in FIG. 4. The claw 17*b* of the lever 17 is adapted to engage the claw 21*a* on the latch lever 21 so as to hold the latch lever 21 in the locking position as shown in FIG. 4. In this position, the latching lever 21 engages the striker 8 so that the door 1 is locked in the closed position.

When it is desired to open the door, the push button 2 is depressed until it engages the unlocking lever 13 and causes the counterclockwise movement thereof. Then, the lower portion 13*b* of the unlocking lever 13 engages the upward projection 17*b* on the claw lever 17 to force the lever 17 to rotate counterclockwise as seen in FIG. 4. Thus, the claw 17*b* on the lever 17 is disengaged from the claw 21*a* on the latch lever 21 whereby the latch lever 21 is rotated clockwise under the influence of the spring 22. The latching finger 21*b* on the lever 21 then forces the striker 8 out of the slot 16*b* so that the door 1 is unlocked and opened.

When the outer panel 3 is deformed due to a crash from behind, the push button 2 may be displaced forwardly from the position shown in FIG. 3. In this instance, however, the bracket 12 and the unlocking lever 13 are also displaced in the same direction as the push button 2 so that the displacement of the push button 2 does not cause any unlocking movement of the lever 13. Further, since the direction of displacement of the unlocking lever 13 is such that the lower portion 13*b* is moved apart from the upward projection 17*b* of the claw lever 17, there is no danger that the claw lever 17 is undesirably driven.

Figure 5:
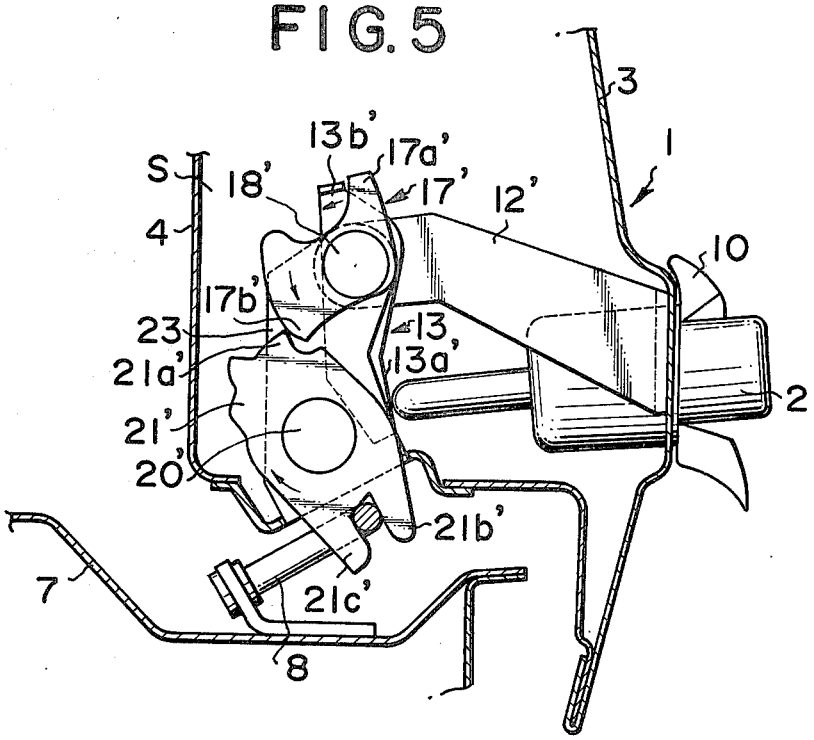
FIG. 5 is a sectional view similar to FIG. 3 but showing another embodiment of the present invention.

Referring to FIG. 5 showing another embodiment of the present invention, the outer panel 3 of the door 1 carries a bracket 12′ at the side opposite to the handle bracket 10 and an unlocking lever 13′ is mounted on the bracket 10 as in the previous embodiment. In this embodiment, however, the unlocking lever 13′ is so arranged that the lower portion 13*a*′ is adapted to be engaged by the push button type member 2 to be rotated thereby counterclockwise as seen in FIG. 5.

A claw lever 17′ is mounted through a pin 18′ on a bracket 23 secured to the inner panel 4 and has an upper projection or engagement portion 17*a*′ which is adapted to engage with an operating or upper portion 13*b*′ of the unlocking lever 13′. On the bracket 23, there is also mounted a latch lever 21′ through a pin 20′. The latch lever 21′ has a claw 21*a*′ and latching fingers 21*b*′ and 21*c*′. The claw lever 17′ has a claw 17*b*′ for engagement with the claw 21*a*′ on the latch lever 21′. The latching fingers 21*b*′ and 21*c*′ engage the striker 8 as the fingers 21*b* and 21*c* do in the previous embodiment. The unlocking lever 13′, the claw lever 17′ and the latch lever 21′ are respectively spring biased as shown by arrows in FIG. 5. The arrangement of this embodiment is different from the previous embodiment in that the bracket 23 extends into the space S between the outer and inner panels and the levers 17′ and the 21′ are positioned in the space S.

The invention has thus been shown and described with reference to specific embodiments, however, it should be noted that the invention is in no way limited to the details of the illustrated structures but changes and modifications may be made without departing from the scope of the appended claims.

I claim:

1. In an automobile including a car body formed with a rear opening, and a rear door provided for closing said opening in the car body and being comprised of outer and inner panels which are secured together with a space therebetween; locking means for the rear door which comprises striker means provided on the car body, latch lever means mounted on the door and movable between a locking position wherein it engages with the striker means and an unlocking position wherein it is disengaged from the striker means, bias means for biasing the latch lever means toward the unlocking position, claw lever means mounted on the door and adapted to engage with the latch lever means for releasably holding the latch lever means in the locking position, unlocking lever means pivotably mounted on said door and have an operating portion adapted to engage with an engagement portions of said claw lever means, push button type actuating means mounted on said outer panel of the door for actuating, when depressed, the unlocking lever means so as to let it drive the claw lever means in a direction of releasing the latch lever means whereby the latch lever means is moved under the action of the bias means to the unlocking position, the improvement comprises the fact that said unlocking lever means is carried in the space of the door by said outer panel at an area close to said actuating means, said claw lever means and said latch lever means being carried by said inner panel, said unlocking lever means being carried by said outer panel having said operating portion located entirely forward of said claw lever means engagement portion and adapted to engage therewith upon a rearward movement to drive said claw lever means in the direction of releasing the latch lever means, whereby even when the outer panel is deformed in a crash the unlocking lever means is not moved into driving engagement with the engagement portion of the claw lever means.

2. Locking means in accordance with claim 1 in which said actuating means is mounted on handle bracket means which is attached to the outer panel at an exterior surface thereof and said unlocking lever means is mounted on further bracket means which is attached to the outer panel at a side opposite to the handle bracket means.

3. Locking means in accordance with claim 1 in which said claw lever means and said latch lever means are mounted on third bracket means carried by said inner panel and positioned outside the space in the door.

4. Locking means in accordance with claim 1 in which said claw lever means and said latch lever means are mounted on third bracket means carried by said inner panel and positioned inside the space of the door.

* * * * *